US006382112B1

(12) United States Patent
Forsberg et al.

(10) Patent No.: US 6,382,112 B1
(45) Date of Patent: May 7, 2002

(54) CHUTE OF A FEED SYSTEM FOR A REFUSE INCINERATION PLANT HAVING A CUTTING APPARATUS

(75) Inventors: Stefan Forsberg, Tomelilla (SE); Jörg Meier, Ottenbach (CH)

(73) Assignee: Von Roll Umwelttechnik AG, Zürich (CH)

( * ) Notice: Subject to any disclaimer, the term of this patent is extended or adjusted under 35 U.S.C. 154(b) by 0 days.

(21) Appl. No.: 09/649,181

(22) Filed: Aug. 28, 2000

(30) Foreign Application Priority Data

Sep. 2, 1999 (CH) ..... 1597/99

(51) Int. Cl.[7] ..... F23K 3/16; F23B 7/00

(52) U.S. Cl. ..... 110/342; 110/116; 110/118; 110/101 C; 110/101 CF; 110/186; 110/219; 110/233; 110/242; 110/267; 110/293; 110/101 R; 414/200

(58) Field of Search ..... 110/116, 117, 110/118, 101 A, 101 C, 101 CF, 101 CD, 186, 191, 196, 197, 218, 219, 233, 235, 242, 267, 286, 289, 293, 346, 342, 101 R; 48/86; 266/176, 177; 414/147, 167, 198, 200; 100/98 R

(56) References Cited

U.S. PATENT DOCUMENTS

| | | | | |
|---|---|---|---|---|
| 900,390 A | * | 10/1908 | Kingsley | |
| 4,200,422 A | | 4/1980 | Stodt | |
| 4,452,154 A | * | 6/1984 | Kono et al. | 110/346 |
| 4,498,380 A | * | 2/1985 | Maus | 100/98 R |
| 4,531,462 A | * | 7/1985 | Payne | 110/210 |
| 4,658,736 A | * | 4/1987 | Walter | 110/346 |
| 4,714,031 A | * | 12/1987 | Healy et al. | 110/109 |
| 4,774,896 A | * | 10/1988 | Michimae | 110/256 |
| 4,796,544 A | | 1/1989 | Overgaard | |
| 4,942,052 A | * | 7/1990 | Posdal | 426/512 |
| 5,022,328 A | * | 6/1991 | Robertson | 110/232 |
| 5,586,855 A | | 12/1996 | Eshleman | |
| 5,655,463 A | | 8/1997 | Good | |
| 5,694,868 A | * | 12/1997 | Mitthof | 110/210 |
| 5,820,999 A | * | 10/1998 | Li et al. | 428/577 |
| 6,125,774 A | * | 10/2000 | Kohler et al. | 110/346 |

FOREIGN PATENT DOCUMENTS

| | | |
|---|---|---|
| DE | 2 101 171 | 7/1971 |
| DE | 36 10 422 A1 | 10/1987 |

* cited by examiner

*Primary Examiner*—Ira S. Lazarus
*Assistant Examiner*—K. B. Rinehart
(74) *Attorney, Agent, or Firm*—Cohen, Pontani, Lieberman & Pavane

(57) ABSTRACT

The chute is provided with a cutting apparatus which has a mating holder, a clamping slide and a cutting slide. To close the chute, the mating holder is moved inward approximately into the center of the chute and is locked. Then, the clamping slide is moved toward the mating holder, until ultimately they come into contact with one another and the chute is closed. If there is refuse between the mating holder and the clamping slide, and consequently the latter cannot reach its closed position, the cutting slide is activated, which cuts through the refuse clamped between the mating holder and clamping slide and bridges the gap between the mating holder and the clamping slide so as to form a seal.

20 Claims, 4 Drawing Sheets

CHUTE OF A FEED SYSTEM FOR A REFUSE INCINERATION PLANT HAVING A CUTTING APPARATUS

BACKGROUND OF THE INVENTION

1. Field of the Invention

The invention relates to a chute of a feed system for a refuse incineration plant having a cutting apparatus. The invention further relates to a method for operating the chute.

2. Discussion of the Prior Art

Refuse incineration plants are generally fed via a so-called feed system: the refuse is conveyed out of a hopper into a chute and onward into a metering device at the end of the chute. The metering device finally provides good metering of the refuse to the furnace.

To prevent the penetration of secondary air, chutes of considerable length (height up to and greater than 10 m) are used, through which the refuse is conveyed solely through the force of gravity.

Again and again, relatively large objects become jammed or clamped in the chute, and refuse sliding down behind such objects is no longer able to free them from such a position. Such objects then have to be removed from the chute by hand, which disrupts the operating cycle, entails an increased risk of accidents and may lead to the penetration of secondary air which has an adverse effect on incineration and emissions.

SUMMARY OF THE INVENTION

The object of the present invention is to provide a chute in which large objects no longer lead to operational disruption, and to provide a method for operating such a chute.

A clamping slide of a cutting apparatus of a chute can be displaced toward a mating holder until they come into contact. This mating holder may be designed as a separate element but may also be formed, for example, by part of a wall of the chute. If, during displacement of the clamping slide toward the mating holder, a relatively large object becomes jammed between the mating holder and the clamping slide, a gap remains open between the two components, and the clamping slide does not reach its closed position. In this event, a cutting slide, which is arranged beneath the clamping slide and the cutting edge of which can be displaced beyond the gap, can be activated so as to cut off that part of the object which projects downward out of the gap. If the clamping slide and the cutting slide are displaced back into their open position, they open up the cross section of the chute, and that part of the object which remains in the gap falls into the chute.

If the mating holder is also designed as a slide element, and if the mating holder and the clamping slide can be moved toward one another on a common plane of movement, there is less risk that, during displacement of the two slide elements, large objects will be carried along sideways over a relatively great distance and consequently will become wedged in place. Moreover, the refuse is released from the center of the chute.

The highly efficient comminution of objects which are clamped in the gap is obtained if the cutting slide can be displaced along a plane which is directly beneath the plane of movement and parallel to the latter. This efficiency can be increased still further if the cutting edge of the cutting slide can be adjusted by means of an adjustment device in such a way that it moves directly along the bottom side of the mating holder.

A cutting edge which is of V-shaped design, and surrounds that part of the object which is to be cut off prior to cutting, from the sides, ensures that that part of the object is cut off, rather than squeezed out, which would require a higher force and therefore a greater outlay on energy.

It is particularly advantageous to close off the chute by means of the cutting apparatus in an at least approximately scaled manner. In this way, in addition to cutting large objects, the cutting apparatus can also be used as a closure device which prevents the penetration of secondary air. This enables the supply of combustion air to be controlled more successfully and therefore results in better combustion, reduced emissions of pollutants, more homogeneous temperature profiles and lower thermal loads in the combustion chamber.

A sealing slide which is arranged beneath the cutting apparatus and is at a distance therefrom can close off the chute so as to form a seal while the cutting apparatus is open. The sealing slide and the cutting apparatus can be used in the manner of a lock, which is particularly advantageous if the refuse incineration plant is to be operated under substoichiometric conditions. In this way, the plant can be rendered inert very efficiently, for example by injecting an inert gas, for example nitrogen, into a lock chamber which is delimited by the sealing slide and the cutting apparatus. This cushion of nitrogen makes it possible to virtually completely seal off the furnace from the atmosphere. The furnace can then be rendered completely inert by injecting further nitrogen.

That section of the chute which is delimited by the sealing slide and a base arranged at the bottom end of the chute has a considerably larger volume than the lock chamber. Consequently, there is always sufficient space beneath the scaling slide for the refuse which falls down out of the lock chamber, and the movement of the sealing slide is not impeded by the refuse.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
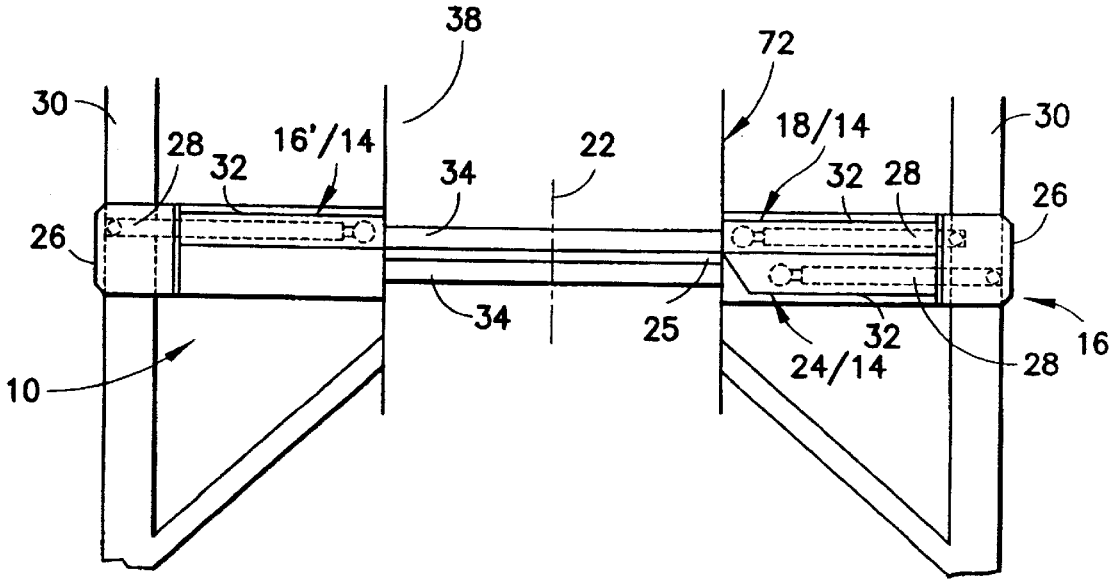
FIG. 1 diagrammatically shows a longitudinal section through part of a chute, with a cutting apparatus having three slide elements, in the open position.

FIG. 1 shows a cutting apparatus 10 of a chute 12, in section transversely with respect to slide elements 14, which belong to the cutting apparatus 10. These slide elements 14 are a plate-like mating holder 16 and a plate-like clamping slide 18, which can be displaced toward one another and away from one another in a common plane of movement at right angles to the longitudinal direction 22 of the chute 12. Immediately beneath the clamping slide 18 there is a cutting slide 24 which is likewise in the form of a plate and can be displaced in a plane which is parallel to the plane of movement and in the same direction as the clamping slide 18. The cutting slide 24 has a cutting edge 25 which, as shown in FIG. 3*b,* is of V-shaped design, in such a manner that objects which are to be cut are surrounded by this cutting edge at the sides.

In FIG. 1, all the slide elements 14 arc in their open position, in which they open up the cross section of the chute 12 entirely. They are displaced into housings 26 which are connected to the chute 12 in a gastight manner and project laterally therefrom. The housings 26 are preferably formed from sheet metal and welded.

All the slide elements 14 can be moved by means of hydraulic piston-cylinder units 28 which are mounted on a frame 30 of the chute 12 and are introduced into the housings 26 so as to form a seal. The piston-cylinder units 28 project into the plate-like slide elements 14, which are designed as a box structure 32, and are internally connected thereto. In this context, the term plate-like means that the length and depth of the slide elements 14 are very much greater compared to their thickness.

Figure 2A:
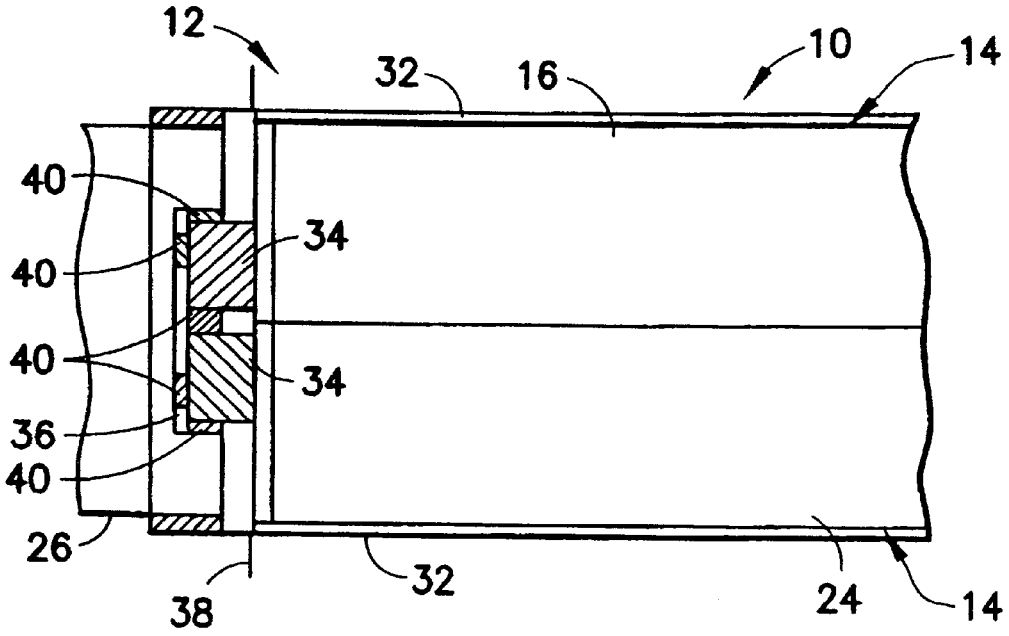
FIGS. 2*a,* 2*b* show the guides for the slide elements in section.

On the sides of the cutting slide 24 and the mating holder 18 there are guide runners 34 which are mounted and guided in guide grooves 36 arranged above one another on two opposite walls 38 of the chute. In FIG. 2*a,* only one of these chute walls 38 with guide grooves 36 and guide runners 34 guided therein is shown. The guide grooves 36 have slide rails 40. As additional measures for sealing and protecting against dirt, it is possible to provide scaling lips, stripper blades and seals. The guide runners 34—in the closing direction—project beyond the cutting slide 24 or mating holder 18, so that in the open position they fill the guide grooves 36 over the entire depth d of the chute. In this way, refuse is prevented from penetrating into the guide grooves 36, and consequently the guides cannot become jammed.

The (guide grooves 36 and the guide runners 34 are designed so that the guide runners 34 do not project beyond the chute wall 38 into the chute 12. Consequently, it is impossible for any refuse to build up on the guide runners 34. It is conceivable to use adjustment elements, for example in the form of adjustment screws, to minimize the play between the guide grooves 36 and the guide runners 34 in a known way.

The cutting edge 25 of the cutting slide 24, the clamping slide 18 and the mating holder 16 are oriented in such a way, with respect to one another, that the cutting edge 25 of the cutting slide 24 slides along the underside of the clamping slide 18 and of the mating holder 16 and, during cutting, interacts optimally with a bottom front edge 54 of the mating holder 16.

Figure 2B:
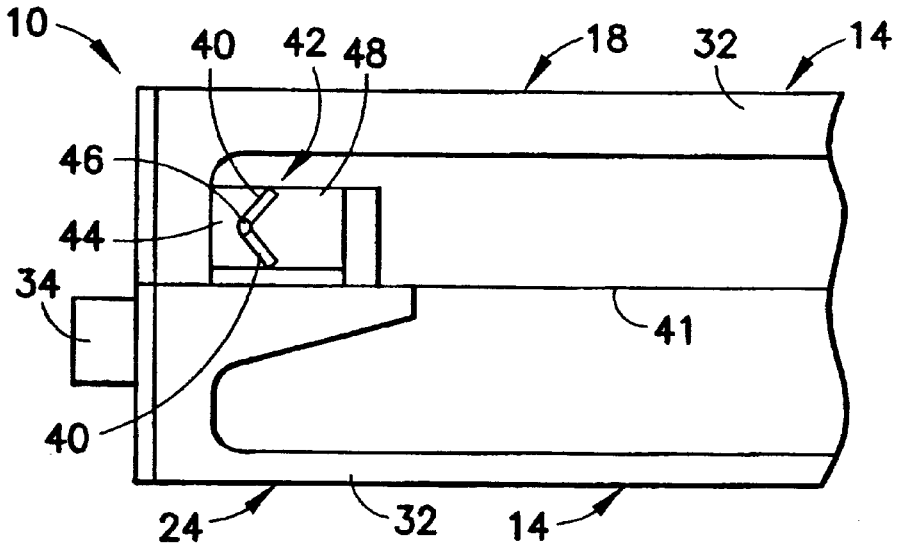

The guides 42 of the clamping slide 18 are situated between the clamping slide 18 and the cutting slide 24. As illustrated in FIG. 2*b,* the box structure 32 of the clamping slide 18 is open on its bottom side 41 facing toward the cutting slide 24. A strut 44 with a groove 46, in which a guide runner 48 attached to the cutting slide 24 engages, is situated on the clamping slide 18, on the inside of the side wall. In this case too, slide rails 40 are fitted in the groove 46.

The method for operating the chute 12 with the Cutting apparatus 10 is explained below with reference to FIGS. 3*a* and 3*b*. When the cutting apparatus 10 is being closed, firstly the mating holder 16 is extended out of its open position, in which it is outside the chute 12 (cf. FIG. 3*a,* I), to the center of the chute 12, into its limit position and is hydraulically locked (cf. FIG. 3*a,* II). Next, the clamping slide 18 is extended out of its open position, if possible into its closed position, i.e. until it is in contact with the mating holder 16 (not shown). In the closed position, the clamping slide 18 is pressed against the mating holder 16 under a force of approximately 300 kN, and the two together close off the chute 12 in an at least approximately, and preferably completely, gastight manner.

Figure 3A:
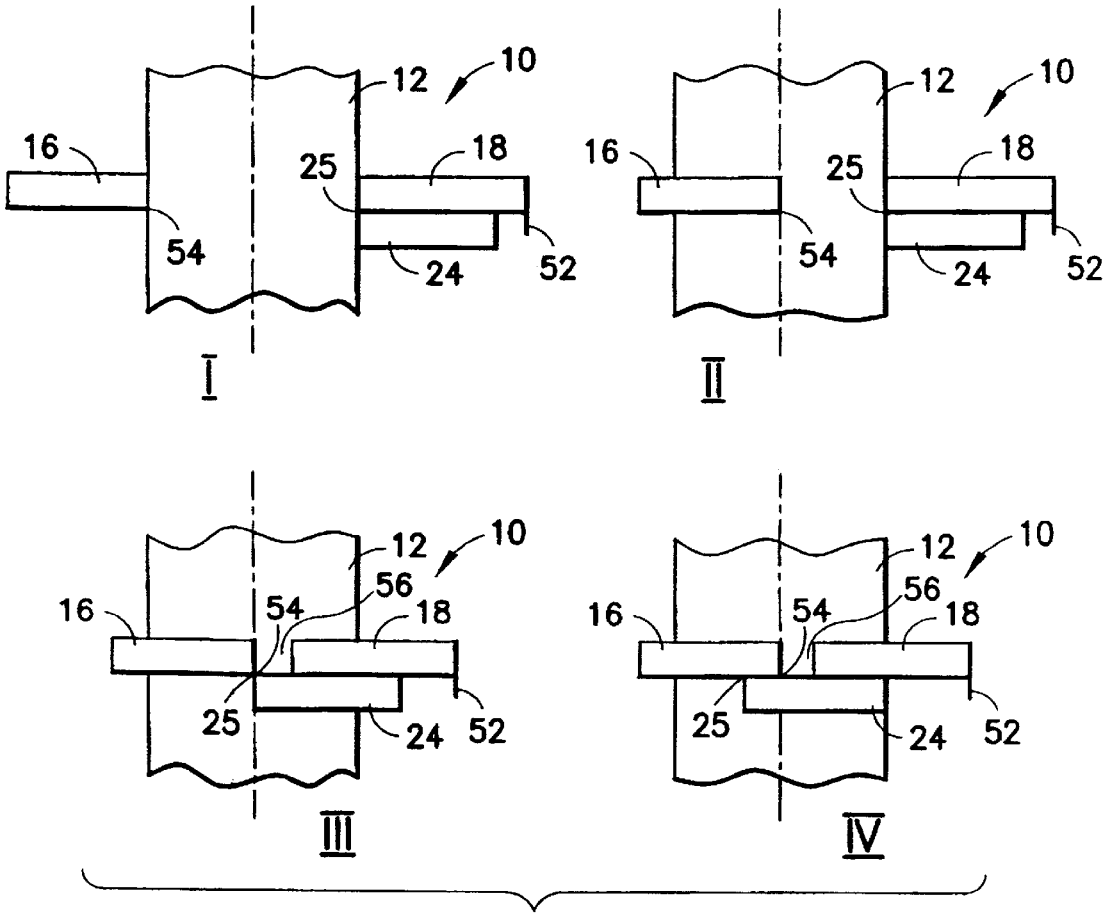
FIG. 3*a* shows successive method steps in the working cycle of the cutting apparatus, in section transversely with respect to the slide elements.
Figure 3B:
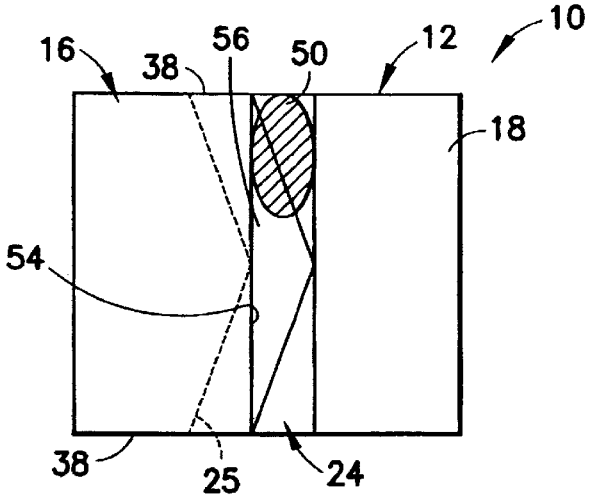
FIG. 3*b* shows the cutting operation from above.

If, during closure of the cutting apparatus 10, a relatively large object 50 passes between the clamping slide 18 and mating holder 16, and the clamping slide 18 cannot be moved into its closed position within a predeterminable time, the cutting slide 24 is activated (cf. FIG. 3*a,* III). To minimize the closing time of the cutting slide 24, the clamping slide 18 is equipped with a projection 52 which, during the displacement of the clamping slide 18 in the closure direction, mechanically moves the cutting slide 24 with it; for this purpose, the drive of the cutting slide 24 has an open hydraulic system. While the clamping slide 18 is held in its clamping position—maintaining the full hydraulic pressure, which facilitates cutting since the material to be cut off is always held securely—the cutting slide 24 is displaced, by means of its piston-cylinder unit 28, into its limit position beyond the gap 56 between mating holder 16 and clamping slide 18 and, in the process, cuts off the jammed object 50 against the lower front edge 54 of the mating holder 16 (cf. FIG. 3*a,* III). The gap 56 is then closed by the cutting slide 24 so as to form a seal; cf. FIG. 3*a,* IV and, in FIG. 3*b,* the closed position of the cutting slide 24 indicated in dashed lines.

FIG. 4 illustrates a feed system 58, in vertical section in the longitudinal direction 22 of the chute 12, with a cutting apparatus 10.

The feed system 58 has a charging funnel 60 which is fed with refuse 61 from the refuse hopper (not shown) by means of a conveyor belt 62; a crane could also be used. The chute 12, at the bottom end 12' of which a metering device 64 is arranged, is connected to the charging funnel 60. In this example, the metering device 64 has a rain 66 which is pushed along a base 64', which serves as a ram table. The metering device 64 feeds the refuse 61 which has been conveyed through the chute 12 from the charging funnel 60 by the force of gravity to a furnace 68 arranged downstream of the metering device 64.

At the bottom end of the charging funnel 60 and therefore at the top end 12" of the chute 12 is arranged the cutting apparatus 10 as shown in FIGS. 1, 2 and 3 and described above. For the sake of simplicity, only the housing 26 of this cutting apparatus is shown, together with an indication of the clamping slide 18 and cutting slide 24.

Figure 4A:
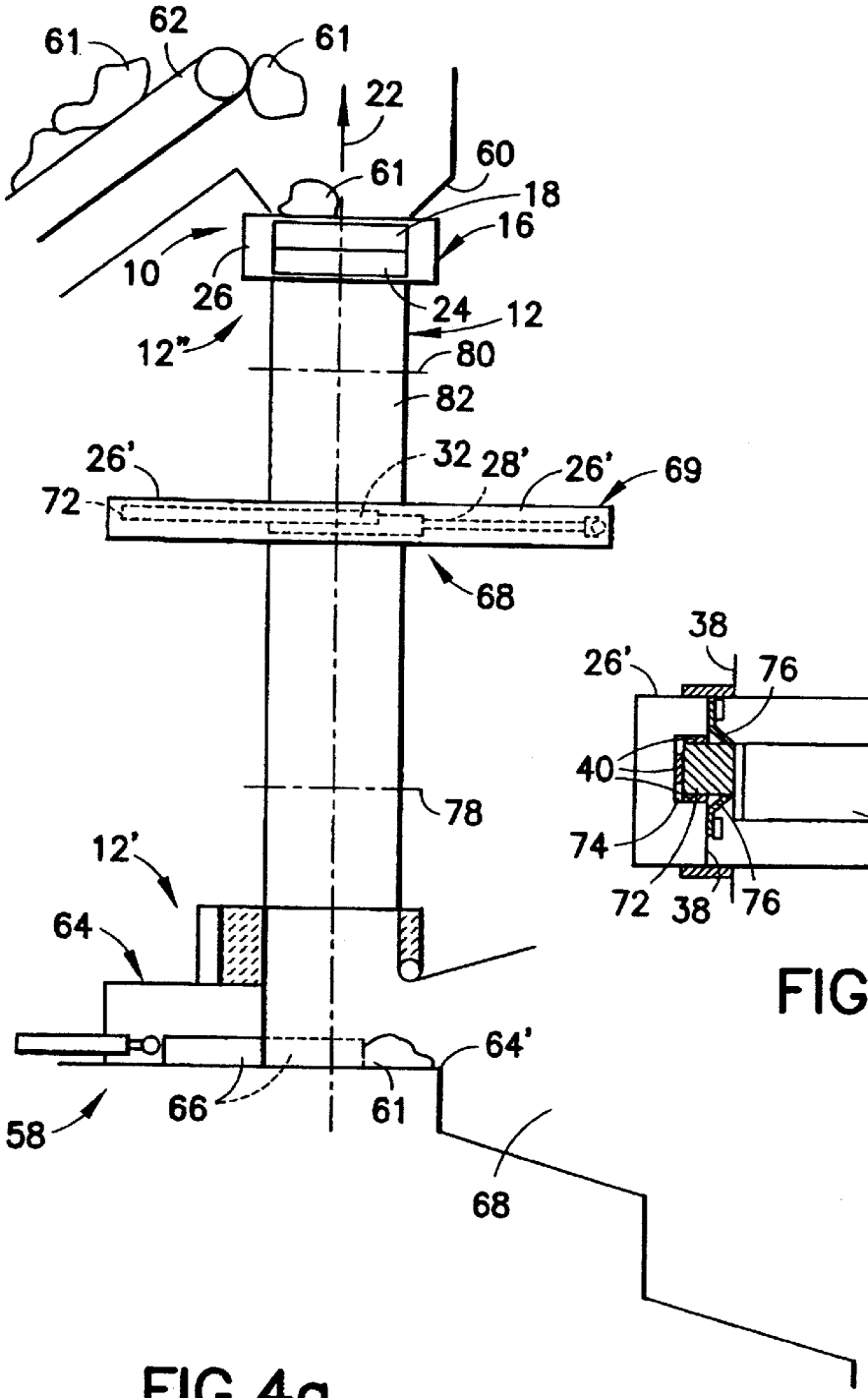
FIG. 4*a* shows a longitudinal section through a chute with cutting apparatus and sealing slide apparatus.
Figure 4B:
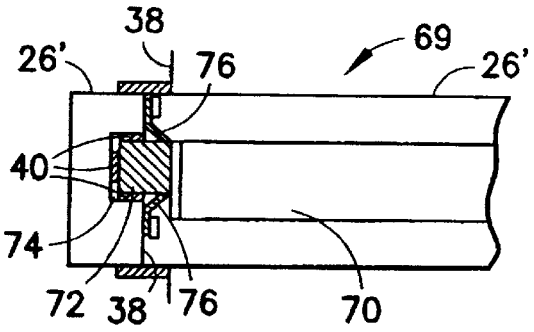
FIG. 4*b* shows part of the sealing slide apparatus, in a view corresponding to that shown in FIG. 2*a,* 2*b.*

At a distance below the cutting apparatus 10 and at a distance above the metering device 64 there is a sealing device 69. The sealing device has a sealing slide 70, which is of similar design to the mating holder 16 designed as sliding element 14 but is of such a size that in the sealing position it closes off the chute 12. The sealing slide 70 can be displaced, by means of a further piston-cylinder unit 28', between the sealing position, which is shown in FIG. 4*a,* and an open position, in which it fully opens up the chute 12. On each of opposite sides, the sealing slide 70 has a side guide runner 72 which is guided in a corresponding guide groove 74 on opposite chute walls 38 and side walls of the associated housings 26'. These are in turn tightly connected to the chute walls. As can be seen from FIG. 4*b,* slide rails 40 are again arranged between the guide grooves 74 and the guide runners 72. Sealing lips 76 are arranged along the guide grooves 74, fixed to the housing or chute wall, and interact with the guide runners 72 in order to achieve an optimum sealing action in the sealed position of the sealing slide 70. In the open position, these guide runners 72 also pass through the chute 12.

At a distance above the base 64' forming the ram table, there is a first filling level sensor 78. A second filling level sensor 80 is arranged in the lock chamber 82 delimited by the sealing device 69 and the cutting apparatus 10. The distance between the second filling level sensor 80 and the sealing device 69 is smaller than the distance between the sealing device 69 and the first filling level sensor 78 arranged beneath it. This ensures that the volume from the sealing slide 70 to the second filling level sensor 80 is smaller than the volume between the first filling level sensor 78 and the sealing slide 70. Also, the volume of the chamber which is present between the base 64' and the sealing device 69 is larger than the volume of the lock chamber 82.

The way in which the feed system 58 shown in FIG. 4*a* functions is as follows: the starting positions are those shown, i.e. the cutting apparatus 10 is in the closed position and the sealing slide 70 is in the sealing position. On top of the sealing slide 70 there is refuse up to the maximum filling level which is detected by the second filling level sensor 80. The ram 66 feeds the furnace 68 with the desired quantity, with the result that the filling level of the chamber beneath the sealing device 69 falls. If this level reaches a minimum filling level which is detected by the first filling level sensor 78, a feed cycle is initiated. In this cycle, the sealing slide 70 is retracted from the sealing position into the open position, with the result that the refuse situated in the lock chamber 82 falls onto the refuse which is still situated on the base 64'. Then, the sealing slide 70 is immediately displaced back into the sealing position. While the sealing slide 70 is in the open position, the cutting apparatus 10 has taken over the sealing function. When the sealing slide 70 is back in the sealing position, the cutting apparatus 10 is opened and the lock chamber 82 is filled up to a maximum filling level which is detected by the second filling level sensor 80. Next, the cutting apparatus 10 is closed and the feed cycle remains in the at-rest position until the first filling level sensor 78 again detects a minimum filling level and starts the feed cycle again. The cutting apparatus 10 is closed as described above.

The best seal of the chute 12 is obtained when both the cutting apparatus 10 and the sealing device 69 are closed. To ensure that this is the case over as long a time as possible, the lock chamber 82 is preferably produced with a sufficiently large storage capacity. For example, if it has a storage capacity corresponding to a quarter of the hourly throughput of refuse, the feed cycle will take place on average four times per hour. Between these feed cycles, all the slides are closed. During the feed cycle, either the sealing device 69 or the cutting apparatus 10 is always closed; they therefore operate in opposing cycles.

Although the cutting apparatus 10 can cut through the refuse 61, it is desired for cutting to occur as rarely as possible, in order to minimize maintenance costs. This is ensured by providing a sufficiently great distance between the second filling level sensor 80 and the cutting apparatus 10. If the refuse contains objects whose length exceeds the height of the lock chamber 82, these objects are cut through by means of the cutting apparatus 10.

If it should prove impossible to cut through a jammed object 50 at the first attempt, the opening, closing and, if appropriate, cutting steps are repeated for a predetermined number of cycles until the cutting slide 24 has completely traversed the gap 56 or the closed position is reached. If the predetermined number of cycles is exceeded, the operation is stopped and a warning message is emitted.

The invention is not limited by the embodiments described above which are presented as examples only but can be modified in various ways within the scope of protection defined by the appended patent claims.

We claim:

1. A method for operating a chute of a feed system for a refuse incineration plant having a cutting apparatus which has a mating holder, a clamping slide, and a cutting slide having a front cutting edge, the clamping slide being moveable between an open position, in which the clamping slide opens up the chute, and a closed position in which the clamping slide closes off the chute by interacting with the mating holder, the cutting slide being pushable with the cutting edge of the cutting slide beyond a gap between the mating holder and the clamping slide if refuse is present between the mating holder and the clamping slide so that said closed position cannot be reached leaving said gap between said mating holder and said clamping slide, said method comprising the steps of: recording filling level with filling-level sensors in the chute; and charging the chute when a defined filling level is reached, for which purpose a working cycle of the cutting apparatus is started, the working cycle including initially displacing the clamping slide and, selectively, the mating holder into an open position, and then, closing the chute by pushing the mating holder into an end position and locking the mating holder in place, subsequently moving the clamping slide toward the mating holder until the clamping slide either reaches a closed position, in which the clamping slide bears against the mating holder, or is held in a position under a defined pressure opposite the mating holder with said gap, and the cutting slide is activated.

2. A method as defined in claim 1, wherein, when the closed position of the clamping slide is not reached, the working cycle of the cutting apparatus is repeated, within a predeterminable number of cycles, until the cutting slide has completely traversed the gap and has reached the closed position, or until the predetermined number of cycles is exceeded, at which point the working cycle is stopped and a warning message is emitted.

3. A method as defined in claim 1, the chute having a base arranged at a bottom of the chute and a sealing slide arranged below and at a distance from the cutting apparatus so that a lock chamber is delimited by the cutting apparatus and the sealing slide, the lock chamber having a volume that is smaller than a volume of a chamber delimited by the sealing slide and the base arranged at the bottom end of the chute, the method further including, after a predetermined, minimum filling level in the chamber between the sealing slide and the base at the bottom end of the chute is detected, opening the sealing slide and emptying contents of the lock chamber into this chamber, then closing the sealing slide and subsequently opening the cutting apparatus and filling the lock chamber to a predeterminable, maximum height, which is smaller than an absolute height of the lock chamber, and finally closing the cutting apparatus.

4. A chute of a feed system for a refuse incineration plant, comprising: a top end; a bottom end; a cutting apparatus arranged at the top end, said cutting apparatus having respective open and closed positions wherein the cutting apparatus opens and closes off said chute top end; a sealing slide arranged in said chute beneath the cutting apparatus;

said sealing slide having an open position and a closed position; a base arranged at the bottom end of the chute, the cutting apparatus and the sealing slide delimiting a lock chamber having a volume which is smaller than a volume of another chamber delimited by the sealing slide and the base; a maximum refuse level sensor arranged in said lock chamber for detecting a maximum accumulated refuse level in said lock chamber; and another filling sensor arranged in said other chamber for detecting a minimum refuse level in said other chamber, on detection of said minimum refuse level in said other chamber, said sealing slide being positioned in open position so that accumulated refuse in said lock chamber falls into said other chamber, the cutting apparatus and the sealing slide being driven in opposing cycles whereby one of the sealing slide and the cutting apparatus is always closed during a refuse feeding cycle.

5. A chute of a feed system for a refuse incineration plant, comprising a cutting apparatus which has a mating holder, a clamping slide, and a cutting slide having a front cutting edge, the clamping slide being moveable between an open position, in which the clamping slide opens up the chute, and a closed position in which the clamping slide closes off the chute by interacting with the mating holder, the cutting slide being pushable with the cutting edge of the cutting slide beyond a gap between the mating holder and the clamping slide if refuse is present between the mating holder and the clamping slide so that said closed position cannot be reached leaving said gap between said mating holder and said clamping slide, the mating holder being a slide element, the mating holder and the clamping slide being displaceable toward one another and away from one another in a common plane of movement, the closed position being at least approximately in the center of the chute.

6. A chute as defined in claim 5, wherein the common plane of movement runs at right angles to a longitudinal direction of the chute.

7. A chute as defined in claim 5, wherein the cutting apparatus is arranged in an upper end region of the chute, and wherein the chute can be closed off in an at least approximately gastight manner by the clamping slide, the mating holder, and the cutting slide.

8. An apparatus as defined in claim 7, and further comprising a base arranged at a bottom of the chute and a sealing slide arranged below and at a distance from the cutting apparatus so that a lock chamber is delimited by the cutting apparatus and the sealing slide, the lock chamber having a volume that is smaller than a volume of a chamber delimited by the sealing slide and the base arranged at the bottom end of the chute.

9. A chute as defined in claim 8, wherein the sealing slide is displaceable so that, in the open position, the slide opens up the cross section of the chute and, in a sealed position in the chute, the slide closes off the chute so as to form a seal.

10. A chute as defined in claim 9, wherein the sealing slide has sides with guide runners which are each mounted in guide grooves arranged on chute walls which lie opposite one another, the guide runners, in the open position, filling the guide grooves over an entire depth of the chute.

11. A chute of a feed system for a refuse incineration plant, comprising a cutting apparatus which has a mating holder, a clamping slide, and a cutting slide having a front cutting edge, the clamping slide being moveable between an open position, in which the clamping slide opens up the chute, and a closed position in which the clamping slide closes off the chute by interacting with the mating holder, the cutting slide being pushable with the cutting edge of the cutting slide beyond a gap between the mating holder and the clamping slide if refuse is present between the mating holder and the clamping slide so that said closed position cannot be reached leaving said gap between said mating holder and said clamping slide, the mating holder being a slide element, the mating holder and the clamping slide being displaceable toward one another and away from one another in a common plane of movement, the cutting slide being parallel to and displaceable immediately below the plane of movement so that the cutting edge is guideable until it comes into contact with an underside of the plane of movement.

12. A chute of a feed system for a refuse incineration plant, comprising a cutting apparatus which has a mating holder, a clamping slide, and a cutting slide having a front cutting edge, the clamping slide being moveable between an open position, in which the clamping slide opens up the chute, and a closed position in which the clamping slide closes off the chute by interacting with the mating holder, the cutting slide being pushable with the cutting edge of the cutting slide beyond a gap between the mating holder and the clamping slide if refuse is present between the mating holder and the clamping slide so that said closed position cannot be reached leaving said gap between said mating holder and said clamping slide, the cutting edge being V-shaped so as to laterally surround refuse which is to be cut.

13. A chute of a feed system for a refuse incineration plant, comprising a cutting apparatus which has a mating holder, a clamping slide, and a cutting slide having a front cutting edge, the clamping slide being moveable between an open position, in which the clamping slide opens up the chute, and a closed position in which the clamping slide closes off the chute by interacting with the mating holder, the cutting slide being pushable with the cutting edge of the cutting slide beyond a gap between the mating holder and the clamping slide if refuse is present between the mating holder and the clamping slide so that said closed position cannot be reached leaving said gap between said mating holder and said clamping slide, the cutting slide being displaceable onto the mating holder from a side of the clamping slide.

14. A chute as defined in claim 13, wherein the cutting slide has a guide, the clamping slide being mounted on the cutting slide so as to be guided by the guide.

15. A chute of a feed system for a refuse incineration plant, comprising a cutting apparatus which has a mating holder, a clamping slide, and a cutting slide having a front cutting edge, the clamping slide being moveable between an open position, in which the clamping slide opens up the chute, and a closed position in which the clamping slide closes off the chute by interacting with the mating holder, the cutting slide being pushable with the cutting edge of the cutting slide beyond a gap between the mating holder and the clamping slide if refuse is present between the mating holder and the clamping slide so that said closed position cannot be reached leaving said gap between said mating holder and said clamping slide, and further comprising chute walls that lie opposite one another, the cutting slide and the mating holder having sides with guide runners, the runners each being mounted in guide grooves arranged on the chute walls so that in the open position the guide runners fill the guide grooves over the entire depth of the chute.

16. A chute of a feed system for a refuse incineration plant, comprising a cutting apparatus which has a mating holder, a clamping slide, and a cutting slide having a front cutting edge, the clamping slide being moveable between an open position, in which the clamping slide opens up the chute, and a closed position in which the clamping slide closes off the chute by interacting with the mating holder, the cutting slide being pushable with the cutting edge of the cutting slide beyond a gap between the mating holder and the clamping slide if refuse is present between the mating holder and the clamping slide so that said closed position cannot be reached leaving said gap between said mating holder and said clamping slide, the clamping slide and the cutting slide each having a dedicated drive element and at a distance from the cutting apparatus so that a locked chamber is delimited by the cutting apparatus and the sealing slide, the locked chamber having a volume that is smaller than a volume of a chamber delimited by the sealing slide and the base arranged at the bottom end of the chute, the sealing slide being displaceable so that, in the open position, the slide opens up the cross-section of the chute and, in a sealed position in the chute, the slide closes off the chute so as to form a seal, the sealing slide having sides with guide runners which are mounted in guide grooves arranged on chute walls which lie opposite one another, the guide runners, in the open position, filling the guide grooves over an entire depth of the chute.

17. A chute as defined in claim 16, wherein the drive element is a piston-cylinder unit.

18. A chute as defined in claim 16, and further comprising a frame arranged on the chute, each drive element being supported on the frame.

19. A chute of a feed system for a refuse incineration plant, comprising a cutting apparatus which has a mating holder, a clamping slide, and a cutting slide having a front cutting edge, the clamping slide being moveable between an open position, in which the clamping slide opens up the chute, and a closed position in which the clamping slide closes off the chute by interacting with the mating holder, the cutting slide being pushable with the cutting edge of the cutting slide beyond a gap between the mating holder and the clamping slide if refuse is present between the mating holder and the clamping slide so that said closed position cannot be reached leaving said gap between said mating holder and said clamping slide, the mating holder being a slide element, the mating holder and the clamping slide being displaceable toward one another and away from one another in a common plane of movement, the clamping slide, the cutting slide and the mating holder each having a dedicated drive element.

20. A chute of a feed system for a refuse incineration plant, comprising a cutting apparatus which has a mating holder, a clamping slide, and a cutting slide having a front cutting edge, the clamping slide being moveable between an open position, in which the clamping slide opens up the chute, and a closed position in which the clamping slide closes off the chute by interacting with the mating holder, the cutting slide being pushable with the cutting edge of the cutting slide beyond a gap between the mating holder and the clamping slide if refuse is present between the mating holder and the clamping slide so that said closed position cannot be reached leaving said gap between said mating holder and said clamping slide, and further comprising a base arranged at a bottom of the chute and a sealing slide arranged below.

* * * * *